US012805590B2

(12) United States Patent
Mustafa

(10) Patent No.: US 12,805,590 B2
(45) Date of Patent: Nov. 24, 2026

(54) FOLDABLE HAT

(71) Applicant: Paulina Mustafa, Edinburgh (GB)

(72) Inventor: Paulina Mustafa, Edinburgh (GB)

( * ) Notice: Subject to any disclaimer, the term of this patent is extended or adjusted under 35 U.S.C. 154(b) by 0 days.

(21) Appl. No.: 18/878,412

(22) PCT Filed: Jun. 28, 2023

(86) PCT No.: PCT/EP2023/067660
§ 371 (c)(1),
(2) Date: Dec. 23, 2024

(87) PCT Pub. No.: WO2024/003142
PCT Pub. Date: Jan. 4, 2024

(65) Prior Publication Data

US 2026/0076433 A1 Mar. 19, 2026

(30) Foreign Application Priority Data

Jun. 28, 2022 (GB) ..... 2209428

(51) Int. Cl.
*A42B 1/201* (2021.01)
*A42B 1/0182* (2021.01)
*A42B 1/208* (2021.01)

(52) U.S. Cl.
CPC ..... *A42B 1/201* (2013.01); *A42B 1/0182* (2021.01); *A42B 1/208* (2013.01)

(58) Field of Classification Search
CPC ..... A42B 1/201; A42B 1/0182; A42B 1/208
See application file for complete search history.

(56) References Cited

U.S. PATENT DOCUMENTS 640,436 A * 1/1900 Anderson ..... A42B 1/201 2/209.7
1,743,432 A * 1/1930 Conklin ..... A42B 1/201 D2/866

(Continued)

FOREIGN PATENT DOCUMENTS

CH 229175 A 10/1943
FR 871272 A 4/1942

(Continued)

OTHER PUBLICATIONS

Combined Search and Examination Report under Sections 17 and 18(3) for corresponding Great Britain Application No. GB2209428.8 dated Apr. 6, 2023.

(Continued)

*Primary Examiner* — Robert H Muromoto, Jr.
(74) *Attorney, Agent, or Firm* — Renner, Otto, Boisselle & Sklar, LLP

(57) ABSTRACT

A foldable hat constructed from a substantially planar net shape having a central hub and a multiplicity of radiating spokes. Each spoke radiates from the central hub and includes: (a) a crown portion extending from the central hub; (b) a brim portion extending from the crown portion, with at least one fold-line therebetween; and (c) a top portion from which the crown portion extends, with at least one fold-line therebetween, the top portions collectively forming the central hub. Adjacent spokes have interstices between their neighbouring crown and brim portions. In a constructed three-dimensional form, neighbouring spokes are attached to one another, and the hat is foldable along lines of attachment into a substantially flat configuration without separation of any line of attachment.

36 Claims, 4 Drawing Sheets

(56) References Cited

U.S. PATENT DOCUMENTS 1,806,225 A * 5/1931 Vernon ..... A42B 1/012 D2/890
1,926,912 A * 9/1933 Miller ..... A42B 1/208 383/902
2,172,510 A * 9/1939 Jaccard ..... A42B 1/208 2/195.7
2,410,158 A * 10/1946 Gardner ..... A42B 1/208 2/209.3
2,493,500 A * 1/1950 Rankin ..... A42B 1/201 2/175.9
2,823,387 A * 2/1958 De Villers ..... A42B 1/012 2/195.7
2,832,961 A * 5/1958 Weiss ..... A42B 1/208 2/202
2,837,746 A * 6/1958 Gundy ..... A42B 1/201 2/205
2,859,447 A * 11/1958 De Villers ..... A42B 1/012 2/195.7
2,990,552 A * 7/1961 De Villers ..... A42B 1/012 2/195.7
3,039,113 A * 6/1962 Lipschutz ..... A42B 1/201 D2/882
3,292,183 A * 12/1966 Story ..... A42B 1/012 2/200.1
3,869,727 A * 3/1975 Hartman ..... A42B 1/201 2/175.1
3,908,199 A * 9/1975 Lim ..... A42B 1/201 2/175.1
3,917,153 A * 11/1975 Holschneider ..... B65D 81/363 446/76
4,246,659 A * 1/1981 Lyons ..... G09F 1/06 2/200.3
4,549,316 A * 10/1985 Johnson ..... A42B 1/0182 2/195.1
4,837,865 A * 6/1989 Roth ..... A47G 23/06 2/209.3
5,010,590 A * 4/1991 Haber ..... A61F 9/045 2/209.3
5,054,123 A * 10/1991 Helms ..... A61F 9/045 2/12
5,173,970 A * 12/1992 Shifrin ..... A42B 3/00 2/209.12
5,247,709 A * 9/1993 Epply ..... A42B 1/201 2/175.1
5,388,272 A * 2/1995 Epply ..... A42B 1/0192 2/175.1
5,450,629 A * 9/1995 Gilstrap ..... A45F 4/02 2/209.12
5,493,732 A * 2/1996 Fawkes ..... A42B 1/201 2/195.1
5,799,335 A * 9/1998 Ethier ..... A42B 1/006 2/209.11
5,802,616 A 9/1998 Watson
5,950,241 A * 9/1999 Gomez ..... A42B 1/201 2/172
6,941,582 B2 * 9/2005 Miska ..... A42B 1/0192 2/200.3
2002/0178486 A1 * 12/2002 Kovalenko ..... A42B 1/0192 2/195.2
2006/0010567 A1 * 1/2006 Vazquez ..... A42B 1/206 2/175.1
2006/0143794 A1 * 7/2006 Hou ..... A42C 5/04 2/200.3
2012/0324627 A1 * 12/2012 Adkins ..... A42B 1/0182 2/209.13
2013/0174322 A1 * 7/2013 Williams ..... A42B 1/248 2/181
2013/0326791 A1 * 12/2013 Woo ..... A42B 1/0187 2/172
2016/0270463 A1 * 9/2016 Kleppen ..... A42B 1/004
2017/0347734 A1 * 12/2017 Sussmann ..... A42B 1/208

FOREIGN PATENT DOCUMENTS

FR 1153447 A 3/1958
FR 3034963 A1 10/2016
GB 2410417 A 8/2005
WO 2012051658 A1 4/2012

OTHER PUBLICATIONS

International Search Report and Written Opinion for related International Application No. PCT/EP2023/067660 mailed Sep. 25, 2023.

Parametric origami hat—Hatori! http://fabtextiles.org/origami-hat-hatori/ Published Feb. 10, 2015, accessed May 4, 2023, relevant to claims 1-21.

* cited by examiner

FOLDABLE HAT

This application is a national phase of International Application No. PCT/EP2023/067660 filed 28 Jun. 2023, which claims priority to Great Britain Application No. 2209428.8 filed 28 Jun. 2022, which is hereby incorporated herein by reference in its entirety.

The present invention concerns a foldable hat.

There are numerous different types of hats that can be worn for different occasions, for example visors, straw hats, sun hats. Whether the hat is large or small, if the wearer no longer wants to wear the hat, it can become an inconvenience to instead have to carry the hat. Hats, depending on their size, can be difficult to carry in a small bag and/or pocket, and if placed in such a carrying device, the hat is likely to become creased, damaged and/or lose its intended shape.

There is a need in the art for a foldable hat that allows a wearer easily to fold and transport the hat when not being worn, for example in a small bag or pocket, rather than having to carry the hat when they no longer want to wear it. It is important that the foldable hat retains its shape and does not become damaged after folding and unfolding multiple times, and even after an extended period of time in the folded configuration.

The use of foldable hats has been explored to a large extent in the art.

For example, GB2410417 describes a hat comprising reinforcement plates and flexible joints so that the hat can be folded.

U.S. Pat. No. 5,802,616 describes a folding hat comprising a flexible and collapsible crown having a top portion and a bottom, generally round peripheral edge, the bottom edge having front, back, and opposite side portions, the crown being provided with a notch in the back of the bottom edge, a brim extending generally radially outwardly from the bottom edge of the crown around substantially the entire periphery thereof, the brim including stiffening means for maintaining the shape of the brim in a configuration which extends generally outwardly from the bottom edge and hinge means for permitting the brim to be folded, and an adjustable sizing band extending across the notch of the crown.

WO2012051658 describes a folding hat formed from sheet material, including a crown and a brim, wherein the brim is attached to the crown, and a bottom rim portion of the crown imparts shaping to the brim.

U.S. Pat. No. 5,950,241 describes headgear comprising a hat having a crown, with a brim completely encircling said crown; said brim including an outer peripheral edge, with a stiff, flexible member disposed within said outer peripheral edge of said brim for twist folding said brim for compactly storing said hat as desired; a drape attached to and depending from said outer peripheral edge of said brim, said drape having a length and a width; and said width extending at least partially about said outer periphery of said brim; wherein said brim and said drape contain cooperative means for adjusting said length of said drape and said width of said drape.

FR3034963 describes a folding hat composed of a cap surrounded by a crown, which is at least partially rigid. The cap has two sides connected at the front and at the rear by a junction line in the longitudinal fold plane and a top with a fold line. The lower edge of the sides is connected to the edge of the crown; this is formed by two rigid crescents, on either side of the folding plane and joined by two tension triangles straddling the folding line at the front and at the rear of the crown.

U.S. Pat. No. 5,247,709 describes a folding hat of stiffly flexible paper-like material comprising: a top panel forming a crown, four planar side panels attached to the top panel along fold lines, the side panels having lower arcuate borders forming an oval, head-shaped opening toward the crown; and four arcuate brim panels flaring from the arcuate borders of the side panels to an ovate brim edge, one side panel having a transverse fold line parallel to and intermediate the crown and brim allowing one side panel to be folded flat.

FR871272A discloses a foldable hat made by folding a flat piece of paper, or stiffened fabric, and which is particularly intended for temporary use. The hat consists of a part limited substantially by the contour of the edge of the hat, and which has, from one of its points, a radiating fan-folding. The hat is formed as a result of traditional pleating, starting from a circular sheet of paper. However, in order fully to fold the hat into a small footprint, it must be cut along one of the folds and requires a securing element to hold the overall 3D shape.

U.S. Pat. No. 640,436A discloses a foldable hat made from a plain length of paper, silk, linen, or other suitable material that is plaited, crimped, waved, corrugates or formed into accordion folds, with the two ends joined together in such a manner as to allow them to be disconnected as required. The hat is formed as a result of a traditional pleating technique starting from a rectangular sheet of paper, and requires more than one step to close, as well as a string to secure the hat in it's 3D conformation.

U.S. Pat. No. 3,869,727A discloses a foldable hat composed of separate interconnected sections, each section including a crown wall portion and a brim portion, with each portion being hingedly connected to one another, defining a hat which is to be collapsed into a folded condition in which the sections are in stacked relation. The hat also includes a top, crown portion, interconnected to the upper zone of the wall by open work strings, and therefore completely decoupled from the crown itself. The hat folds into an accordion design, first folding flat and then alternately inwards and outwards, requiring two steps.

U.S. Pat. No. 3,908,199A discloses a foldable hat with ribs stacked and joined pivotally at inner ends. A flexible connector sequentially joins outer ends, permitting the ribs to be spread as radii in a complete circle. Releasable fasteners connect outer sections of upper and lower ribs to complete a circular form. The hat requires more than one step to close and requires securing elements to maintain the hat in its 3D configuration.

CH229175 discloses a hat having a brim and a crown. This hat is formed of a single piece of foldable material and can be folded without releasing a securing element. However, because hat has only a short downwardly sloping brim and a curved crown it is poorly adapted to provide a wide range of hat geometries or to provide a swift and single-step folding means.

U.S. Pat. No. 2,493,500 discloses a hat formed from a single piece of material, having a brim, crown and top portion. The hat can be collapsed to a flat condition as a result of mountain and valley folds formed in the hat to allow it to collapse, however, as a result of the crown's facets of a quadrilateral shape, the hat may only be flattened into a non-compact form.

FR1153447 discloses a hat formed by a folded piece of card, there is a fastening to connect one end of the card with another to form the hat in the shape of a continuous cone.

The hat requires securing elements to maintain the hat in it's 3D configuration, which must be released for the hat to be folded.

The arrangements in the art typically involve folding techniques that require a sequence of folds in different directions, for example as described in U.S. Pat. No. 5,802,616 and/or successive and complicated folding stages, for example as described in U.S. Pat. Nos. 5,247,709 and 3,869,727. Such folding techniques are complex and may be tedious and/or inelegant, making it more difficult for an end user easily to compact the hat.

Some arrangements in the art are based on the concepts of origami, and are produced as a result of complex folding of a single continuous piece of 2-D material that is folded into a 3-D form, and can be unfolded to return it to its 2-D form, for example as described by FR871272, US640436, WO2012051658, and in http://fabtextiles.org/origami-hat-hatori/. Such designs are ill-adapted to retain a suitable hat shape for the wearer in the absence or a securement thread or ribbon, and consequently are also ill-adapted to provide a convenient, robust hat which can be very conveniently folded into a storage condition, and unfolded into a wearing condition.

It would appear that none of the prior art documents provide a fully foldable hat having a constructed 3D form and aspect ratio of a conventional sunhat for example, but with satisfactory means for folding it in a single fluid motion into a small article. None of the prior art examples disclose any mechanism for folding flat in a single radially inward motion, and without needing a securing means to maintain the hat in it's 3D form, which is also durable and can withstand repeated folding and unfolding. Most require a string or some sort of adhesive to hold the hat together in its 3D form, and all require at least two steps.

One object of the present invention is, therefore, to provide an alternative way of folding a hat into a folded configuration, in a single step and without the need for a securing element.

A foldable hat must be rigid enough to hold the intended three-dimensional shape of the hat when being worn, whilst additionally providing means to easily fold the hat into a compact configuration when not being worn. The resulting configuration must be easy to transport and store, and the folding of the hat must not damage the design or shape of the hat. Thus, the folding of the hat must be easily reversible between its compact, folded, and useful, unfolded, forms.

Thus, there is a need for a hat that can be easily folded into a compact configuration in a reduced number of steps and wherein the hat can maintain the desired shape during use when unfolded. It is also important that the hat can be folded into a compact configuration, so that it can be easily transported and stored when not in use, for example in a small bag or pocket.

Another object of the present invention is, therefore, to provide a foldable hat without a need for a securing element, devised with these issues in mind.

According to the present invention there is provided a foldable hat constructed from a 2-D net shape comprising a central hub and a multiplicity of radiating spokes, each spoke of the 2-D net shape radiating from the central hub and comprising:

a. a crown portion extending from the central hub;

b. a brim portion extending from the crown portion; with at least one fold-line therebetween; and c. a top portion from which the crown portion extends, with at least one fold-line therebetween, the top portions of radiating spokes collectively forming the central hub;

wherein adjacent spokes have interstices between their neighbouring crown and brim portions.

Preferably no interstices are formed between neighbouring top portions so that the hat in constructed form has continuous surface forming its top, effective to keep off sun and rain.

The foldable hat may have at least one fold-line between neighbouring top portions, facilitating folding of the hat.

Each spoke, including its top portion forming part of the central hub, may radiate outwardly from the centre of the hub, and a continuous unbroken flat surface so that the hat in constructed form has continuous surface forming its top, crown and brim, effective to keep off sun and rain. To facilitate this there are typically no interstices formed between the central hub and each crown portion extending therefrom.

To facilitate folding of the hat the interstices formed between neighbouring crown portions may have substantially the same geometrical shape as the top portion of each radiating spoke between which each interstice is situated.

Preferably each crown portion has a proximal edge engaging with the central hub and a distal edge engaging with the brim portion. In this case each crown portion proximal edge may engage directly with the central hub along the entirety of its length.

Any radiating spoke portion may be provided by a conjoined multiplicity of sub-portions. Such sub-portions may have fold-lines therebetween, the fold-lines extending radially with the spoke.

In its constructed 3-D hat form each radiating spoke is attached or secured to opposite neighbouring radiating spokes, wherein the hat is foldable along lines of attachment between neighbouring spokes into a substantially flat configuration without separation of any line of attachment.

It will be seen from the description which follows that the constructed 3-D hat form is flattenable by means of folding, but not by means of unfolding.

Foldable lines of attachment may extend between the crown and brim portions of neighbouring radiating spokes. These foldable lines of attachment may be configured to allow the hat to be folded along them, without the requirement of releasing any securing element.

The central hub becomes a top portion of the hat in its constructed form and is common to a plurality of the radiating spokes. The top portion may be contiguous with multiple crown portions around substantially the whole of its perimeter or circumference.

The lines of attachment may be configured to allow mountain and valley folds to be formed in the hat. Adjacent lines of attachment may be configured to form alternating mountain and valley folds in the hat. The respective orientation of neighbouring mountain/valley folds in the crown may match the respective orientation of corresponding neighbouring mountain/valley folds in the brim. The respective orientation of neighbouring mountain/valley folds in the top portion may be oppositely matched to the pattern of corresponding neighbouring mountain/valley folds in the crown and brim.

The foldable hat in constructed 3D form has a crown comprising a plurality of crown facets (each formed from crown portions of radiating spokes) foldably connected to one another via the lines of attachment. The crown facets may have a quadrilateral shape, optionally substantially trapezoidal or substantially rectangular. The constructed form has a brim comprising a plurality of brim facets (each formed from brim portions of radiating spokes) foldably connected to one another via the lines of attachment. The brim facets may have a substantially trapezoidal shape. The constructed form has a top comprising a plurality of top facets (each formed from top portions of radiating spokes) foldably connected to one another. The top facets may have a substantially triangular shape.

One significant advantage of the inventive hat is that a range of hat geometries can be created by adjusting the aspect ratios of top, crown and brim components. In one embodiment the hat is suitably provided as a sun hat for example, and the aspect ratio (the ratio between the width of the hat in it brim and the height of the hat in its crown) is at least about 1:1, preferably at least about 1.5:1 and more preferably at least about 2:1.

In the constructed form the brim may extend continuously around the entire periphery of the base of the crown. The top, the crown and the brim may together form a continuous surface. Preferably, in its constructed 3-D hat form, there is a distinct geometry break between the brim, crown and top sections. The brim is within 45°, optionally within 30°, optionally within 25° of being parallel to the top. The crown is within 45°, optionally within 30°, optionally within 25° of being perpendicular to the top and/or to the brim.

The constructed hat can of course alternate between a folded (flat) configuration and an unfolded (ready to wear) configuration. The folded configuration may have less than 50%, less than 20%, less than 10% or less than 5% of the surface area occupied by the hat in its unfolded configuration.

In its constructed 3-D hat form each radiating spoke may be attached or secured to opposite neighbouring radiating spokes, and the hat may then be foldable along lines of attachment between neighbouring spokes into a substantially flat configuration without separation of any line of attachment.

It is only in the 3-D form that the radiating spokes are joined together by a attaching or securing means to form the constructed ready to wear unfolded hat. Once the radiating spokes are joined together by the securing means the hat may not be simply spread out flat into the 2-D net shape, as with an origami hat for example. The hat must be folded to flatten it into a compact form.

The foldable lines of attachment may extend between the crown and brim portions of neighbouring radiating spokes and may be configured to allow the hat to be folded along them, without the requirement of releasing any securing element.

In this context, by "configured to allow the hat to be folded along them" it is preferably meant that the radially symmetric fold lines are configured to allow mountain and valley folds to be formed in the hat, sometimes referred to as accordion folds. Preferably, the fold lines are configured such that the mountain and valley folds are formed simultaneously.

Preferably, in its constructed 3-D hat form, each radiating spoke is attached to opposite neighbouring radiating spokes, where the hat is foldable along lines of attachment between neighbouring spokes into a substantially flat configuration without separation of any line of attachment.

Preferably, radially adjacent fold lines are configured to form alternating mountain and valley folds in the hat. Such an arrangement has been found to facilitate single motion radial folding and unfolding of the hat.

The mountain and valley folds may be formed in both the crown and brim. Preferably, the pattern of mountain/valley folds in the crown matches the pattern of mountain/valley folds in the brim.

Folding can be initiated by applying inward pressure from opposite sides of the crown, the application of inward pressure causes the hat to fold radially inward in a single motion. This folding mechanism is both simple and quick, particularly compared to prior art arrangements. Advantageously, the inward pressure can be applied at any point around the crown owing to the radially symmetric nature of the fold lines.

Radial folding of the hat results in a plurality of folded sections which can be arranged to lie in the same plane i.e., a flat arrangement. This configuration may be referred to as the "folded configuration" or "compact configuration". Conversely, the term "unfolded configuration" or "erect configuration", "constructed form" or "ready to wear form" refers to the hat when it is in the form to be worn.

Thus, according to another aspect of the invention, there is provided a method of folding the hat into a folded configuration, comprising the steps of:

applying inward pressure from opposite sides of the crown effective to fold the hat radially inward in a single motion and form a plurality of folded sections; and arranging the folded sections to lie in the same plane.

The folding of the hat is reversible. In other words, the 3-D hat can be unfolded, and reused as a hat. However, the 3-D hat cannot (without unpicking or otherwise separating adjacent spokes) be returned to its 2-D form, as with an origami hat made from a single sheet of material. In other words, the constructed 3-D hat form is flattenable by means of folding, but not by means of unfolding.

The plurality of radially symmetric fold lines may be configured to allow the hat to be unfolded radially outward in a single motion. In this context, by "configured to allow the hat to be unfolded radially outward" it is preferably meant that the radially symmetric fold lines are configured to allow mountain and valley folds formed in the hat to be opened. Preferably, the fold lines are configured such that the mountain and valley folds are opened simultaneously.

To transition from the folded configuration to the unfolded configuration, opposite sides of the folded brim may be pulled apart. This single motion causes the mountain and valley folds to open and the hat to unfold. Again, the unfolding mechanism is both simple and quick, particularly compared to prior art arrangements.

Advantageously, the folding and unfolding of the hat is repeatable. In other words, the hat can alternate between the folded configuration and the unfolded configuration many times—this can be done without creasing or otherwise damaging the hat.

The crown may comprise a plurality of facets. The crown facets may be foldably connected to one another via the radially symmetric fold lines.

Each of the crown facets may be the same size and shape. Preferably, the crown facets have a quadrilateral shape.

The shape of the crown facets may be dependent on the desired crown style. For example, the crown facets may have a substantially trapezoidal shape to form a tapered crown. Alternatively, for a vertical (no taper) crown, the crown facets may have a substantially rectangular shape.

Preferably, the radially symmetric fold lines are configured to allow the top section to fold inwards i.e., towards the middle of the folded configuration. In this scenario the top section comprises a pattern of mountain/valley folds opposite to the pattern of mountain/valley folds in the crown and brim.

The top section may comprise a plurality of facets (which are distinct from the crown facets previously described). The top section facets may be foldably connected to one another via the radially symmetric fold lines. Preferably, the top section may be formed from a plurality of top facets, which in the unfolded configuration are flat relative to one another.

Each of the top section facets may be the same size and shape. Preferably, the top section facets have a substantially triangular shape. These triangular facets may be arranged such that the matching vertex in each individual facet meets in the centre of the top section.

The shape of the crown may be determined by the crown height, crown taper and/or crown diameter at the base of the crown. The crown taper may have a positive angle—in other words, the diameter of the crown decreases from the base of the crown to the top. Alternatively, the crown taper may have a negative angle—in other words, the diameter of the crown increases from the base of the crown to the top.

The brim may comprise a plurality of facets. The brim facets may be foldably connected to one another via the radially symmetric fold lines.

Preferably, the brim facets have a substantially trapezoidal shape.

The angles between the crown facets, the crown angles, will be determined by the number of divisions in the hat and the size of regular polygon it creates, along with any crown taper. The angle between crown facets is therefore controllable and changeable by changing the number of divisions in the hat. The angle between brim facets, the brim angles, is independent of the resultant crown angle, and can range from 0° to 90°.

The number of top, brim and/or crown facets may for example be between 12 and 18, most preferably 16. The angles between the top facets may be between 0° and 5°, preferably as flat as possible. The angle between crown facets may be described by the following equation (360°/Number of facets)±2°. The angle between brim facets may be between 0° and 90°, preferably 0° and 60°, and most preferably between 5° and 20°.

The brim may have a radially symmetric shape, for example circular. In this scenario, each of the brim facets has the same size and shape. Alternatively, the brim may have a radially asymmetric shape, for example oblong or oval. In some embodiments, the brim may have a front portion which extends radially outwards from the crown to a greater extent than a back portion of the brim, for example the brim may have a peak-cap style where the front portion is long and the back portion is comparatively short.

Whilst the fold lines extending through the crown and brim are radially symmetric, the shape of the brim itself need not be radially symmetric. It has advantageously been found that the radial folding mechanism is not negatively affected when the brim has a radially asymmetric shape.

Each of the crown facets comprise a bottom edge and optionally a top edge i.e., where a top section is present. The bottom edge of each the crown facets is aligned to form the base of the crown.

Each of the brim facets comprise an inner edge and an outer edge. The inner edge of each of the brim facets may be adjacent to a corresponding bottom edge of a crown facet, and may be foldably connected thereto.

Preferably, the bottom edge of the crown facet is the same length and has the same angle as the corresponding inner edge of the brim facet. This allows the crown facet to support the brim facet at that angle i.e., in the unfolded configuration.

Each of the top section facets comprise an outer edge which may be adjacent to a corresponding top edge of a crown facet, and may be foldably connected thereto. Preferably, the outer edge of the top section facet is the same length as the corresponding top edge of the crown facet.

In another aspect of the invention, the foldable hat comprises a plurality of spokes, wherein each spoke comprises an aligned brim facet, crown facet and top facet. The plurality of spokes may be made from a single continuous sheet of material. However, in that case the material would require selection (in terms for example of its thickness and/or stiffness) to hold a fold or pleat, and it is therefore preferable for ease of folding of the constructed form of hat for the spokes to be formed from separate facets that are joined together by a suitable securement or attachment means.

Consequently, it is preferred that each spoke be constructed from separate top, crown and brim facets secured to each other top-to-crown and crown-to-brim in a manner to provide fold-lines therebetween.

The spokes may be foldably connected to one another via the radially symmetric fold lines. Radially adjacent fold lines are preferably configured to form alternating mountain and valley folds. Along the spoke, the mountain/valley fold pattern of the brim facets matches the mountain/valley fold pattern of the crown facets. However, the mountain/valley fold pattern of the top facets can either match the mountain/valley fold pattern of the brim/crown facets or be the opposite of the mountain/valley fold pattern of the brim/crown facets.

Where the top facets have the opposite mountain/valley fold pattern, the top section folds inwards and an even more compact configuration can be achieved.

The crown is foldably connected to the brim and the top section.

The crown may be connected to the brim at its base by any suitable connecting means, for example stitching or adhesive. Similarly, the top section may be connected to the crown by any suitable connecting means, for example stitching or adhesive.

The facets in the crown, brim and/or top section may be connected to each other by a securing means. such as stitching or adhesive (adhesive strip or tape overlapping facets to be secured, for example). Other securing means such as hook and loop fastening means, slim buttons and the like may be considered but tend towards bulk in the hat and thereby mitigate to some extent against ease or effectiveness of folding. Consequently, less bulky securing means such as stitching or adhesive are preferred.

The brim may extend radially outwardly from the crown. The brim may extend continuously around the entire periphery of the base of the crown.

The foldable hat according to the invention can have many different shapes, styles and sizes depending on the application requirements and wearer preference, whilst maintaining the easy folding mechanism.

To achieve the different shapes, styles and sizes, the dimensions which define the hat can be independently varied. For example, the hat size (based on the crown base diameter), crown height, crown taper, brim width, brim angle, and/or number of facets in the crown, brim and/or top section, can all vary independently.

In some embodiments, the foldable hat according to the invention may have an aspect ratio wherein the width of the hat (the diameter of the brim) is at least twice the height of the hat (the crown). Hats with an aspect ratio of at least two are particularly useful for applications as sun hats, as they provide enhanced shade to the user.

The foldable hat according to the invention may be composed of a wide variety of materials with different characteristics, provided the materials selected for securing individual facets of the hat together (stitching or adhesive tape/strip for example) have the required flexibility to allow for folding of the hat, and that the material of the facets have the required stiffness to maintain a three-dimensional shape in the unfolded configuration.

The hat material itself may possess the required stiffness to maintain the three-dimensional shape of the hat in the unfolded configuration. Such materials possess a suitable stiffness to weight ratio.

Materials which do not possess the required stiffness per se may still be used in the foldable hat, provided they are used in conjunction with a stiffening means which allows the three-dimensional shape of the hat to be maintained in the unfolded configuration.

The stiffening means may comprise one or more stiffening panels and/or reinforcing members, for example. The stiffening means may be formed of paper, cardboard, plastic, or wire, for example. The stiffening means may extend throughout one or more of the brim, crown, and/or top facets, and/or at the perimeter of these facets.

By way of specific and non-limiting examples, the hat material may comprise felt, which may be natural, synthetic or a mix of both; wool; straw, which may be natural, synthetic or a mix of both, for example sinamay or buntal; canvas; leather; denim; cotton; cardboard; and/or plastic.

Felt may be a particularly preferred material as it can be chemically treated e.g., starched, to provide the required stiffness to weight ratio to maintain the three-dimensional shape of the hat in the unfolded configuration.

In some embodiments, the foldable hat may be predominantly or entirely composed of cardboard or plastic. Such a foldable hat may be particularly suitable for short-term uses, for example at sporting events.

The brim, crown and/or top section of the hat may be formed of the same material or may be formed of different materials.

It will be appreciated that the foldable hat may comprise one or more decorative features.

In an alternative embodiment of the invention the hat top may comprise an aperture, or be omitted altogether in order to provide a visor-like foldable arrangement. In the this case there is provided in accordance with the invention a foldable visor constructed from a 2-D net shape comprising a multiplicity of radiating spokes, each spoke of the 2-D net shape radiating outwardly and comprising:

a. a crown portion extending from the virtual centre of the 2-D net shape; and b. a brim portion extending from the crown portion; with at least one fold-line therebetween;

wherein adjacent spokes have interstices between their neighbouring crown and brim portions.

Absent reference to the top portion of the hat the foregoing description and it individual and preferred embodiments apply equally to the foldable visor of the invention.

Overall, the foldable hat or visor according to the invention may have a versatile appearance.

The invention will now be more particularly described with reference to the following figures, in which:

FIG. 1 illustrates the folding mechanism of the foldable hat in accordance with the present invention, from the unfolded configuration (A) to the folded configuration (E).

Figure 1:
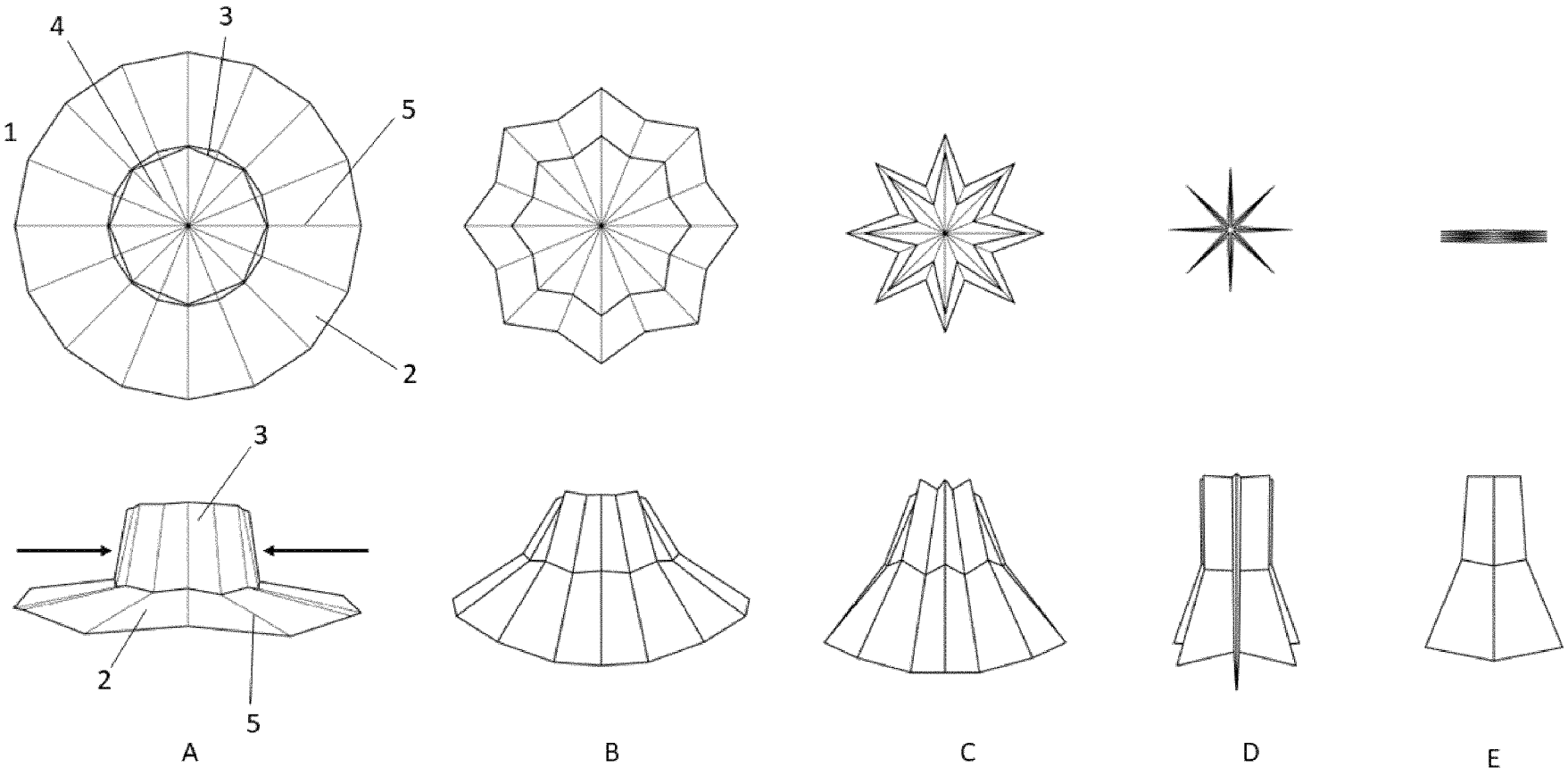
FIG. 1 illustrates the folding mechanism of a foldable hat in accordance with the present invention (left to right—images A to E). The top row of images illustrates a top plan view of the foldable hat and the bottom row of images illustrates the corresponding side view of the foldable hat.

Foldable hat (1) includes a brim (2), a crown (3) and a top section (4). Each of the brim, crown and top section comprises a plurality of facets foldably connected to one another via radially symmetric fold lines (5).

The brim (2) extends radially outwardly from the crown (3). In this embodiment, the brim has a circular shape. In other embodiments, the brim may have a radially asymmetric shape, for example oblong or oval.

Folding is initiated by applying inward pressure from opposite sides of the crown (3) as indicated by the arrows in image A. The application of inward pressure causes the hat to fold radially inward in a single motion as shown in images B to D. As can be seen in these images, adjacent fold lines form alternating mountain and valley folds in the brim and crown. The pattern of the mountain/valley folds in the crown matches the pattern of the mountain/valley folds in the brim. Conversely, the pattern of the mountain/valley folds formed in the top section (4) is opposite to the pattern of mountain/valley folds in the crown and brim meaning the top section folds inwards (not shown).

Radial inward folding of the hat (1) results in a plurality of folded sections as shown in image D. These folded sections can be arranged to lie in the same plane i.e., a flat arrangement, as shown in image E. In this embodiment, half of the folded sections are arranged on one side and half on the other side. Image E shows the foldable hat in its folded configuration. This configuration allows the hat to be easily transported and stored, for example in a small bag or pocket.

Figure 2:
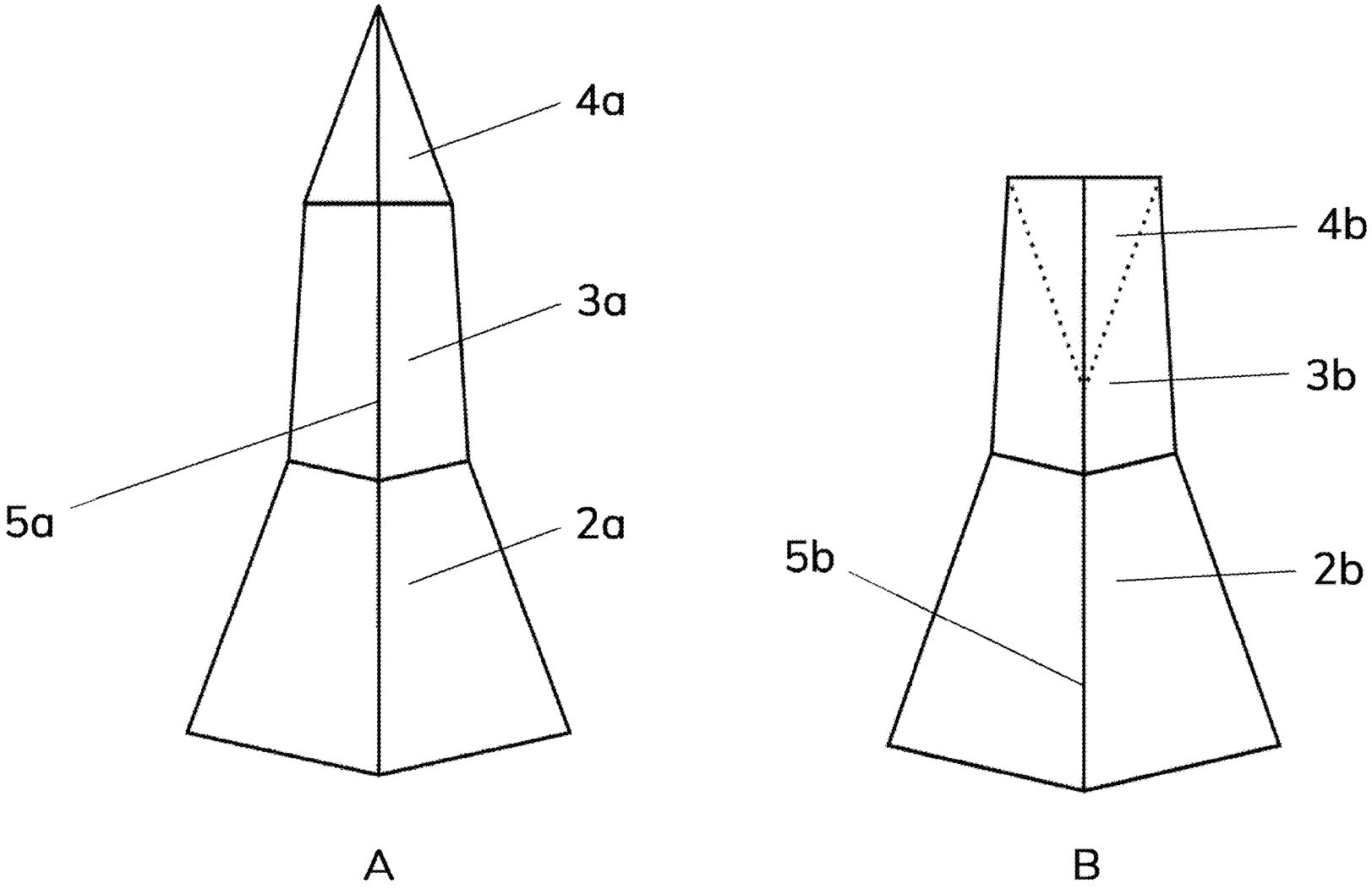
FIG. 2 illustrates a side view of the foldable hat in the folded configuration with the top section folded outwards (A) or inwards (B).

FIG. 2 illustrates a side view of the foldable hat in the folded configuration with the top section folded outwards (A) or inwards (B). The foldable hat comprises a plurality of sectors, wherein each sector comprises an aligned brim facet (2*a*, 2*b*), crown facet (3*a*, 3*b*) and top facet (4*a*, 4*b*). The sectors are foldably connected to one another via the radially symmetric fold lines (5*a*, 5*b*).

Radially adjacent fold lines are configured to form alternating mountain and valley folds. Along the sector, the mountain/valley fold pattern of the brim facets matches the mountain/valley fold pattern of the crown facets.

FIG. 2A shows a foldable hat where the mountain/valley fold pattern of the top facets matches the mountain/valley fold pattern of the brim/crown facets. This results in the top facets (4*a*) folding outwards in the folded configuration, FIG. 2B shows a foldable hat where the mountain/valley fold pattern of the top facets is the opposite of the mountain/valley fold pattern of the brim/crown facets. This results in the top facets (4*b*) folding inwards and an even more compact configuration being achieved.

Figure 3:
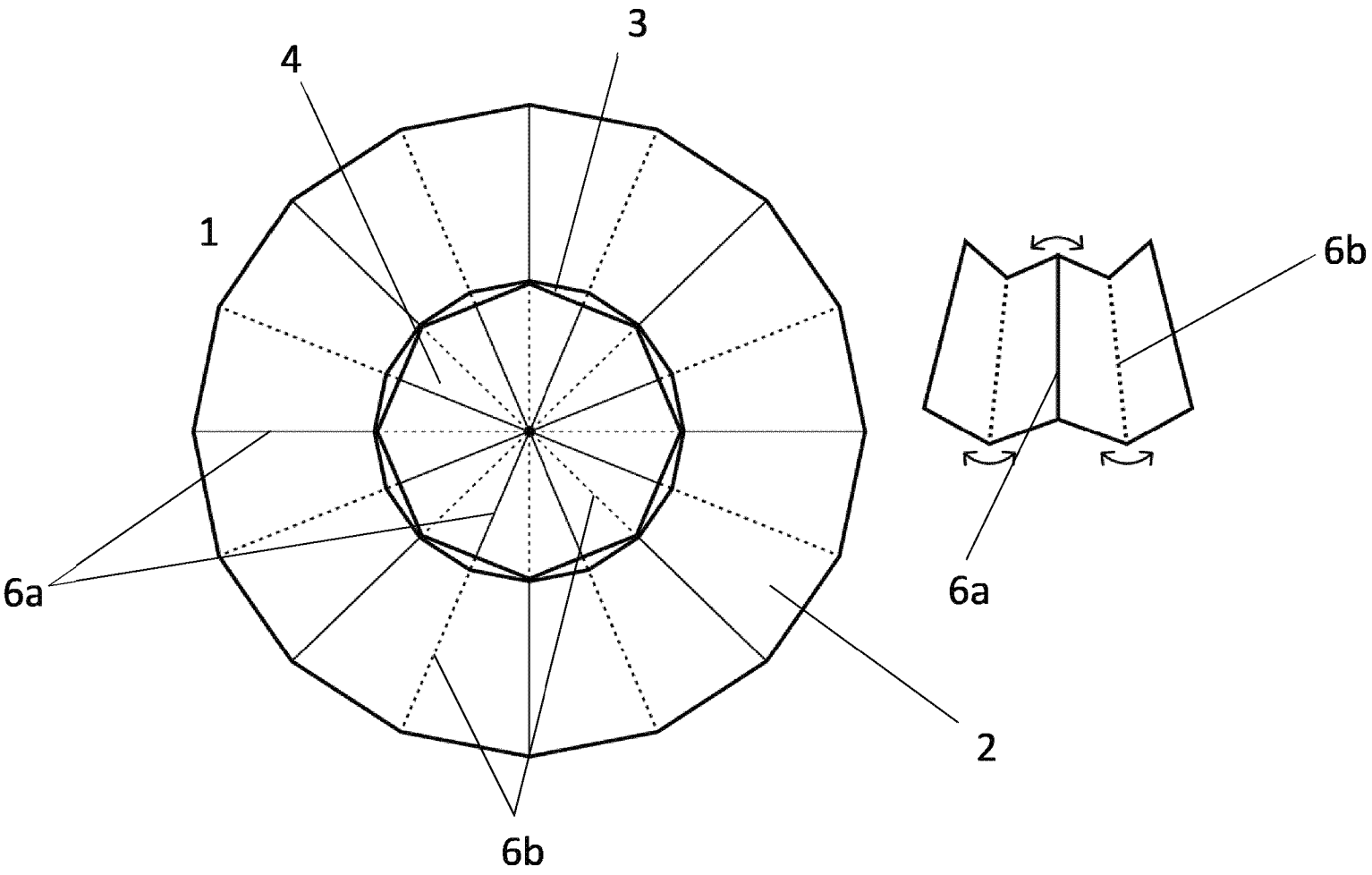
FIG. 3 illustrates the pattern of mountain and valley fold lines in a foldable hat in accordance with the present invention (left image) and how mountain and valley folds are formed upon folding (right image).

FIG. 3 illustrates the pattern of mountain and valley fold lines in a foldable hat in accordance with the present invention (left image) and how mountain and valley folds are formed upon folding (right image).

Foldable hat (1) includes a brim (2), a crown (3) and a top section (4). Each of the brim, crown and top section comprises a plurality of facets foldably connected to one another via radially symmetric fold lines.

The radially symmetric fold lines are configured to allow alternating mountain and valley folds to be formed in the brim (2), crown (3) and top section (4). The fold lines configured to form mountain folds are represented by solid lines (6*a*) and the fold lines configured to form valley folds are represented by dotted lines (6*b*). Mountain and valley folds are formed along fold lines 6*a* and 6*b* respectively when the hat is folded (right image).

The pattern of mountain/valley fold lines (6*a*, 6*b*) in the crown (3) matches the pattern of the mountain/valley fold lines in the brim (2). The pattern of mountain/valley fold lines in the top section (4) is the opposite of the mountain/valley fold line pattern in the brim/crown. This arrangement allows the top section of the hat to fold inwards and a very compact configuration to be achieved.

Figure 4:
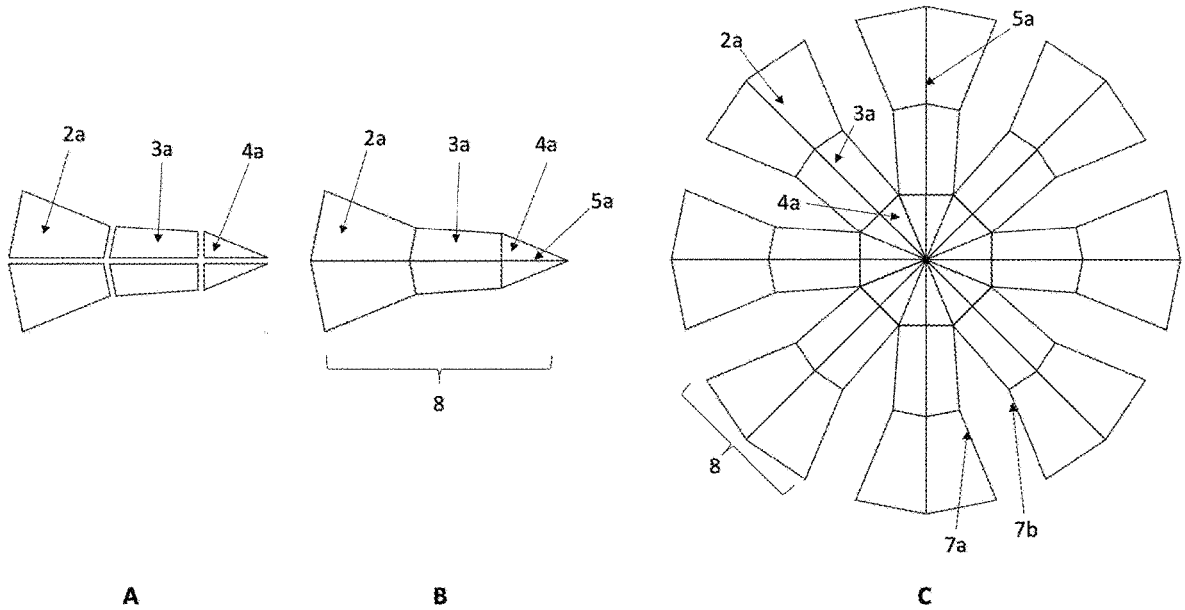
FIG. 4 illustrates the pattern of the 2-D form of the hat prior to construction, illustrating the spokes and the interstices between them.

FIG. 4 illustrates the pattern of the 2-D form of the hat prior to construction, illustrating the spokes and the interstices between them. Each of the brim, crown and top section comprises a plurality of facets foldably connected to one another via radially symmetric fold lines.

FIG. 4A shows the individual facet shapes that may be joined together to form a spoke (8) of the 2-D form of the foldable hat. The facet shapes comprise, a pair of brim facets (2*a*), a pair of crown facets (3*a*) and a pair of top facets (4*a*), all of which are symmetrical. These individual facets may be joined together to form a spoke (8), by securing them along the symmetrical fold lines.

FIG. 4B shows a combined 2-D spoke (8) that comprises brim (2*a*), crown (3*a*) and top (4*a*) facets, linked by radially symmetric fold lines (5*a*).

FIG. 4C shows the pattern of the combined 2-D form of the hat prior to construction. The 2-D form comprises a plurality of spokes (8), each of which comprise a pair of brim (2*a*), crown (3*a*) and top (4*a*) facets foldably connected to one another via radially symmetric fold lines (5*a*). The 2D form may be a single continuous sheet, or each of the facets or spokes may be joined by a securing means. When the hat is constructed in to 3-D form, each of the spokes are joined together along securing lines (7*a* and 7*b*) via a securing means, which may be reversible or irreversible. The 3-D hat is then foldable into a compactable form, as illustrated in FIG. 1.

The invention claimed is:

1. A foldable hat constructed from a substantially planar net shape comprising a central hub and a multiplicity of radiating spokes, each spoke of the substantially planar net shape radiating from the central hub and comprising:

a. a crown portion extending from the central hub;

b. a brim portion extending from the crown portion; with at least one fold-line therebetween; and c. a hub-forming top portion from which the crown portion extends, with at least one fold-line therebetween, the top portions of radiating spokes collectively forming the central hub;

wherein adjacent spokes have interstices between their neighbouring crown and brim portions; and wherein the interstices formed between neighbouring crown portions have substantially the same geometrical shape as the top portion of each radiating spoke between which each interstice is situated.

2. The foldable hat of claim 1, wherein no interstices are formed between neighbouring top portions of adjacent spokes.

3. The foldable hat of claim 2, having at least one fold-line between neighbouring top portions.

4. The foldable hat of claim 1, wherein each spoke, including its hub-forming top portion forming part of the central hub, radiates outwardly from the centre of the hub, forming a continuous unbroken flat surface.

5. The foldable hat of claim 1, wherein no interstices are formed between the central hub and each crown portion extending therefrom.

6. The foldable hat of claim 1, wherein each crown portion has a proximal edge engaging with the central hub and a distal edge engaging with the brim portion.

7. The foldable hat of claim 6, wherein each crown portion proximal edge engages directly with the central hub along the entirety of its length.

8. The foldable hat of claim 1, wherein any radiating spoke portion is provided by a conjoined multiplicity of sub-portions.

9. The foldable hat of claim 8, wherein conjoined sub-portions have fold-lines therebetween, the fold-lines extending radially with the spoke.

10. The foldable hat of claim 1, wherein in its constructed 3-D hat form each radiating spoke is attached or secured to opposite neighbouring radiating spokes, wherein the hat is foldable along lines of attachment between neighbouring spokes into a substantially flat configuration without separation of any line of attachment.

11. The foldable hat of claim 10, wherein the constructed 3-D hat form is flattenable by means of folding, but not by means of unfolding.

12. The foldable hat of claim 10, wherein the foldable lines of attachment extend between the crown and brim portions of neighbouring radiating spokes.

13. The foldable hat of claim 12, wherein the foldable lines of attachment are configured to allow the hat to be folded along them, without the requirement of releasing any securing element.

14. The foldable hat according to claim 10, wherein the central hub becomes a hub-forming top portion of the hat in its constructed form and is common to a plurality of the radiating spokes.

15. The foldable hat of claim 14, wherein the hub-forming top portion is contiguous with multiple crown portions around substantially the whole of its perimeter or circumference.

16. The foldable hat according to claim 10, wherein the lines of attachment are configured to allow mountain and valley folds to be formed in the hat.

17. The foldable hat according to claim 16, wherein adjacent lines of attachment are configured to form alternating mountain and valley folds in the hat.

18. The foldable hat according to claim 17, wherein the respective orientation of neighbouring mountain/valley folds in the crown matches the respective orientation of corresponding neighbouring mountain/valley folds in the brim.

19. The foldable hat according to claim 18, wherein the respective orientation of neighbouring mountain/valley folds in the hub-forming top portion is oppositely matched to the pattern of corresponding neighbouring mountain/valley folds in the crown and brim.

20. The foldable hat according to claim 10, having a crown comprising a plurality of crown facets, each crown facet being formed from crown portions of radiating spokes, the crown facets being foldably connected to one another via the lines of attachment.

21. The foldable hat according to claim 20, wherein the crown facets have a quadrilateral shape, optionally substantially trapezoidal or substantially rectangular.

22. The foldable hat according to claim 20, having a brim comprising a plurality of brim facets, (each brim facet being formed from brim portions of radiating spokes), the brim facets being foldably connected to one another via the lines of attachment.

23. The foldable hat according to claim 22, wherein the brim facets have a substantially trapezoidal shape.

24. The foldable hat according to claim 20, having a top comprising a plurality of top facets, each top facet being formed from hub-forming top portions of radiating spokes, the top facets being foldably connected to one another.

25. The foldable hat according to claim 24, wherein the top facets have a substantially triangular shape.

26. The foldable hat according to claim 22, wherein the brim extends continuously around the entire periphery of the base of the crown.

27. The foldable hat of claim 24, wherein the top, the crown and the brim together form a continuous surface.

28. The foldable hat of claim 27, wherein the brim is within 45°, optionally within 30°, optionally within 25° of being parallel to the top.

29. The foldable hat of claim 26, wherein the crown within 45°, optionally within 30°, optionally within 25° of being perpendicular to the top and/or to the brim.

30. The foldable hat of claim 22, having an aspect ratio, the aspect ratio between the width of the hat in its brim and the height of the hat in its crown, optionally the aspect ratio being at least about 1:1, optionally at least about 1.5:1, optionally at least about 2:1.

31. The foldable hat according to claim 20, which can alternate between a folded configuration and an unfolded configuration.

32. The foldable hat according to claim 31, wherein the folded configuration has less than 50%, less than 20%, less than 10% or less than 5% of the surface area occupied by the hat in its unfolded configuration.

33. The foldable hat of claim 1 wherein the hat top comprises an aperture, or is omitted altogether in order to provide a visor-like foldable arrangement.

34. A foldable visor constructed from a substantially planar net shape comprising a multiplicity of radiating spokes, each spoke of the substantially planar net shape radiating outwardly and comprising:

a. a crown portion extending from the virtual centre of the substantially planar net shape;

b. a brim portion extending from the crown portion; with at least one fold-line therebetween; and c. a hub-forming top portion from which the crown portion extends, with at least one fold-line therebetween, the top portions of radiating spokes collectively forming the hub-forming top portion;

wherein adjacent spokes have interstices between their neighbouring crown and brim portions and wherein the interstices formed between neighbouring crown portions have substantially the same geometrical shape as the top portion of each radiating spoke between which each interstice is situated.

35. The foldable visor hat of claim 34, wherein in its constructed 3-D hat form each radiating spoke is attached or secured to opposite neighbouring radiating spokes, wherein the visor is foldable along lines of attachment between neighbouring spokes into a substantially flat configuration without separation of any line of attachment.

36. A method of folding the foldable hat of claim 32, or the visor according to claim 34 or claim 35, comprising the steps of:

a. applying inward pressure from opposite sides of the crown effective to fold the hat radially inward in a single motion and form a plurality of folded sections; and b. arranging the folded sections to lie in substantially the same plane.

* * * * *